US010487705B2

(12) United States Patent
Pegg et al.

(10) Patent No.: US 10,487,705 B2
(45) Date of Patent: Nov. 26, 2019

(54) ENGINE ASSEMBLY

(71) Applicant: Ford Global Technologies, LLC, Dearborn, MI (US)

(72) Inventors: Ian Graham Pegg, Chelmsford (GB); Emad Abdul Wahab, Billericay (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/625,662

(22) Filed: Jun. 16, 2017

(65) Prior Publication Data

US 2017/0362973 A1 Dec. 21, 2017

(30) Foreign Application Priority Data

Jun. 20, 2016 (GB) ..... 1610703.9

(51) Int. Cl.
*F01M 11/02* (2006.01)
*F01M 1/02* (2006.01)
(Continued)

(52) U.S. Cl.
CPC ..... *F01M 1/02* (2013.01); *F01M 1/12* (2013.01); *F01M 1/16* (2013.01); *F01M 11/02* (2013.01); *F01L 1/24* (2013.01); *F01L 1/3442* (2013.01); *F01M 2001/0246* (2013.01); *F01M 2001/0261* (2013.01); *F01M 2001/0269* (2013.01); *F01M 2001/123* (2013.01); *F01M 2011/021* (2013.01); *F01P 3/08* (2013.01); *F01P 2003/006* (2013.01)

(58) Field of Classification Search
CPC ..... F01M 1/16; F01M 1/02; F01M 2001/123; F01M 1/20; F20D 13/0246
USPC ..... 123/196 R
See application file for complete search history.

(56) References Cited

U.S. PATENT DOCUMENTS 4,285,200 A * 8/1981 Byrne ..... F02B 37/10 60/599
4,478,043 A * 10/1984 Kobavashi ..... F02B 37/10 417/286
(Continued)

FOREIGN PATENT DOCUMENTS

DE 102011075793 A1 11/2012
DE 202014101338 U1 4/2014
(Continued)

OTHER PUBLICATIONS

European Patent Office, Extended European Search Report Issued in Application No. 17173503.8, dated Nov. 8, 2017, Germany, 7 pages.
(Continued)

*Primary Examiner* — Long T Tran
*Assistant Examiner* — James J Kim
(74) *Attorney, Agent, or Firm* — Geoffrey Brumbaugh; McCoy Russell LLP

(57) ABSTRACT

An engine assembly is provided. The engine assembly comprises an oil system comprising: a first oil pump configured to supply oil at a first pressure to one or more first components of the engine assembly; and a second oil pump configured to supply oil at a second pressure to one or more second components of the engine assembly, the second pressure being higher than the first pressure; wherein the second oil pump is provided adjacent to a valve train of the engine assembly.

18 Claims, 3 Drawing Sheets

(51) Int. Cl.

| | |
|---|---|
| ***F01M 1/12*** | (2006.01) |
| ***F01M 1/16*** | (2006.01) |
| *F01L 1/24* | (2006.01) |
| *F01L 1/344* | (2006.01) |
| *F01P 3/08* | (2006.01) |
| *F01P 3/00* | (2006.01) |

(56) References Cited

U.S. PATENT DOCUMENTS

| | | | | |
|---|---|---|---|---|
| 5,245,970 | A | 9/1993 | Iwaszkiewicz et al. | |
| 5,924,286 | A * | 7/1999 | Kapich | F02B 37/10 123/565 |
| 6,082,321 | A | 7/2000 | Kopec | |
| 6,601,557 | B1 | 8/2003 | Hayman et al. | |
| 2003/0188704 | A1 * | 10/2003 | Aimone | F01L 1/022 123/90.17 |
| 2007/0084431 | A1 * | 4/2007 | Omachi | F01M 1/02 123/196 R |
| 2009/0195398 | A1 * | 8/2009 | Usukura | F16D 48/02 340/644 |
| 2013/0042826 | A1 * | 2/2013 | Melecosky | F01L 9/02 123/90.12 |
| 2013/0151113 | A1 * | 6/2013 | Chung | F01M 1/16 701/102 |
| 2013/0188704 | A1 | 7/2013 | Zhou | |
| 2015/0066332 | A1 * | 3/2015 | Leone | F02D 41/04 701/102 |
| 2017/0159508 | A1 * | 6/2017 | Kusanagi | F02D 13/0219 |

FOREIGN PATENT DOCUMENTS

| | | | |
|---|---|---|---|
| EP | 1455057 | A1 | 9/2004 |
| GB | 2322416 | A | 8/1998 |
| GB | 2323636 | A | 9/1998 |
| GB | 2522705 | A | 8/2015 |
| WO | 0106101 | A1 | 1/2001 |
| WO | 2008029240 | A1 | 3/2008 |
| WO | 2011141130 | A1 | 11/2011 |
| WO | 2015047577 | A1 | 4/2015 |

OTHER PUBLICATIONS

Intellectual Property Office of Great Britain, Combined Search and Examination Report Issued in Application No. GB1610703.9, dated Dec. 14, 2016, South Wales, 7 pages.

Great Britain Intellectual Property Office, Examination Report Issued in Application No. GB1610703.9, dated Aug. 11, 2017, 4 pages.

* cited by examiner

ENGINE ASSEMBLY

CROSS REFERENCE TO RELATED APPLICATION

The present application claims priority to Great Britain Patent Application No. 1610703.9, filed Jun. 20, 2016. The entire contents of the above-referenced application are hereby incorporated by reference in its entirety for all purposes.

TECHNICAL FIELD

The present disclosure relates to an engine assembly comprising an oil system and is particularly, although not exclusively concerned, with an engine assembly comprising an oil system configured to improve the fuel consumption of the engine assembly.

BACKGROUND

An internal combustion engine includes many components that require a supply of oil in order to operate most effectively. Oil may be provided in order to lubricate movement of the components and/or cool the components.

Oil that has been delivered to the components drains back to an oil sump of the engine assembly and is stored in the oil sump until it is pumped back to one of the oil consuming components of the engine.

An oil pump is often provided close to the oil sump of the engine and is configured to pump a supply of oil to each of the oil consuming components of the engine. The oil pump is typically a mechanical pump driven by a shaft of the engine. The oil consuming components may require a high pressure and/or flow rate of oil and hence the oil pump may draw a significant amount of power from the engine in order to operate.

STATEMENTS OF INVENTION

According to an aspect of the present disclosure, there is provided an engine assembly, the engine assembly comprising an oil system comprising: a first oil pump configured to supply oil at a first pressure to one or more first components of the engine assembly; and a second oil pump configured to supply oil at a second pressure to one or more second components of the engine assembly, the second pressure being higher than the first pressure. The second oil pump is provided adjacent to a valve train of the engine assembly, e.g. packaged within or next to the valve train of the engine assembly. The first oil pump is a variable pressure pump and the second oil pump is a fixed pressure pump.

The first and second pumps may be vertically spaced apart. The second oil pump may be provided at or near to the top of the engine assembly. The second pump may be located closer to the second components than the first pump. The second pump may be located closer to the second components than an oil sump of the engine.

The second oil pump may be mounted to the engine assembly at or close to a cam shaft of the engine assembly. The second oil pump may be driven by the cam shaft.

The first oil pump may be driven by a different shaft of the engine assembly to the second oil pump. For example, the first pump may be provided adjacent to, e.g. at or next to, a crank shaft of the engine assembly. The first oil pump may be driven by the crank shaft of the engine assembly. The first pump may be located closer to the first components than the second pump. The first oil pump may be provided close to an oil sump of the engine assembly.

The first oil pump may be configured to supply oil to one or more of a journal bearing, e.g. a crank shaft journal bearing, a piston cooling jet and a turbocharger of the engine assembly, e.g. a low pressure feed of the turbocharger. In other words, the first oil pump may be configured to supply oil to one or more components of the crank train and/or the pistons of the engine assembly.

The second oil pump may receive inlet oil from an outlet of the first oil pump. The second oil pump may be configured to supply oil to one or more of a hydraulic lash adjustor, a variable valve timing system, a chain tensioner and a turbocharger of the engine assembly. In other words, the second oil pump may be configured to supply oil to one or more components of a valve train, e.g. a valve train primary drive system, of the engine assembly and/or components configured to control the valve train primary drive.

The first components of the engine assembly may be provided at or close to the crank shaft of the engine assembly. The second components of the engine assembly may be provided at or close to the cam shaft of the engine assembly.

The first oil pump may be configured to pump oil at a first flow rate. The second oil pump may be configured to pump oil at a second flow rate. The first flow rate may be greater than the second flow rate. The flow rate of oil pumped by the first oil pump may be more than double, e.g. an order of magnitude greater than, the flow rate of oil pumped by the second oil pump.

The oil system may further comprise a first pressure relief valve provided downstream of the first oil pump and configured to control the pressure rise across the first oil pump, e.g. such that the inlet pressure of oil to the second oil pump is less than or equal to a threshold value.

The oil system may further comprise a second pressure relief valve provided downstream of the second oil pump and configured to control the pressure rise across the second oil pump.

The oil system may further comprise a third pressure relief valve provided downstream of the second oil pump and configured to control the absolute pressure of oil leaving the second oil pump, e.g. relative to the pressure of oil in the oil sump of the engine assembly. The third pressure relief valve may be configured to control the absolute pressure of oil to be less than an absolute threshold value. The absolute threshold value may be less than or equal to the sum of the pressure rises permitted by the first and second pressure relief valves.

The first oil pump may be configured to allow a difference in pressure between an inlet and outlet of the pump to be selectively varied.

The second oil pump may be configured to provide a fixed pressure difference between an inlet and an outlet of the pump.

The first oil pump may be driven by a first shaft of the engine assembly. The second oil pump may be driven by a second shaft of the engine assembly.

The second shaft may be closer to the second components of the engine assembly than the first shaft.

The first shaft may be a crank shaft of the engine assembly. The second shaft may be a cam shaft of the engine.

The first and/or second shaft may be driven by an electric motor of the engine assembly. In other words, the first and/or second oil pump may be electrically driven.

A motor vehicle may comprise the above-mentioned engine assembly.

To avoid unnecessary duplication of effort and repetition of text in the specification, certain features are described in relation to only one or several aspects or embodiments of the disclosure. However, it is to be understood that, where it is technically possible, features described in relation to any aspect or embodiment of the disclosure may also be used with any other aspect or embodiment of the disclosure.

BRIEF DESCRIPTION OF THE DRAWINGS

For a better understanding of the present disclosure, and to show more clearly how it may be carried into effect, reference will now be made, by way of example, to the accompanying drawings. The figures are drawn to scale, although other relative dimensions may be used, if desired.

DETAILED DESCRIPTION

Figure 1:
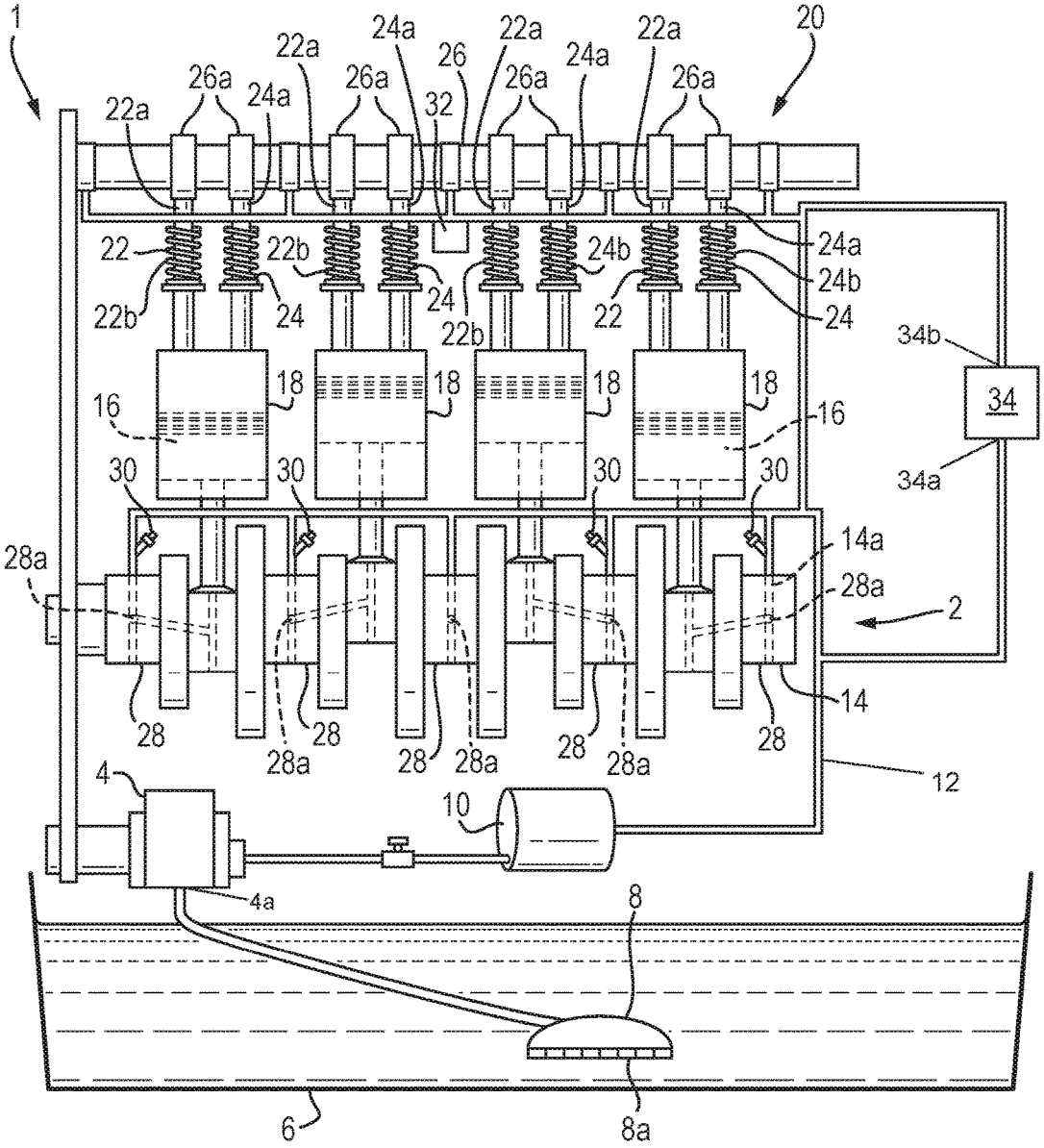
FIG. 1 is a schematic view of a previously proposed engine assembly.

With reference to FIG. 1, an engine assembly 1 comprises an oil system 2, a crank shaft 14 and a plurality of pistons 16 configured to reciprocate within a plurality of cylinders 18. The engine assembly 1 further comprises a valve train 20 comprising a plurality of inlet and outlet valves 22, 24 and a cam shaft 26.

The inlet and outlet valves 22, 24 are configured to control the flow of inlet and exhaust gases into and out of the cylinders 18 respectively. The cam shaft 26 is configured to control the operation of the inlet and outlet valves 22, 24.

The oil system 2 comprises an oil pump 4 configured to draw oil from an oil sump 6 via an oil pick-up 8 to an inlet 4*a* of the oil pump. As shown in FIG. 1, the oil pump may be driven by the crank shaft 14 via a drive belt 5. The oil pick up 8 may comprise a pick-up filter 8*a* configured to reduce the amount of particles or debris drawn from the oil sump 6 into the oil system 2.

The oil pump 4 may be configured to pump a flow of oil through the oil system 2. The oil pump 4 may be a fixed oil pump configured to pump the oil to a predetermined pressure. Alternatively, the oil pump 4 may be a variable oil pump configured to vary a pressure of oil being output by the oil pump. The variable oil pump may be controlled according to an oil pressure requirement of the engine assembly 1.

The oil system 2 may further comprise an oil filter 10. The oil filter may receive oil from the oil pump 4. The oil filter 10 may be configured to filter the oil to reduce the quantity of particles present in the oil being pumped through the oil system 2.

Oil that passes through the oil filter 10 may enter an oil duct 12. The oil duct may be configured to deliver the oil to oil consuming components of the engine assembly 1.

As depicted in FIG. 1, the engine assembly 1 may comprise a plurality of journal bearings 28. The journal bearings 28 may be configured to support the crank shaft 14 and may allow the crank shaft 14 to rotate relative to the engine assembly 1. Each of the journal bearings 28 may comprise a journal bearing oil feed 28*a*. Oil may flow through the oil feeds 28*a* into each of the journal bearings and may lubricate the journal bearings to reduce friction between the crank shaft 14 and the journal bearings 28.

The oil duct 12 may deliver oil from the oil system 2 to an oil channel 14*a* provided in the crank shaft 14. The oil channel 14*a* may be configured to allow oil to flow through the crank shaft 14 to the journal bearings oil feeds 28*a*.

It may be desirable to deliver sufficient oil through the oil feeds 28*a*, such that oil may coat substantially the full area of the journal bearings 28 that is in contact with the crank shaft 14. As the crank shaft 14 rotates, oil may be forced out of the journal bearings 28 and may drain through the engine assembly 1 to the oil sump 6. It may therefore be desirable for the oil system 2 to provide a flow, e.g. a continuous flow, of oil through the oil channel 14*a* to the journal bearing oil feeds 28*a*.

As shown in FIG. 1, the engine assembly 1 may further comprise a plurality of piston cooling jets 30. Each of the piston cooling jets may be configured to direct a jet of oil onto a respective piston 16 of the engine assembly. Providing the jet of oil from the piston cooling jets 30 may cool the pistons 16 and may improve the efficiency of the engine assembly 1. Use of the piston cooling jets 30 may be beneficial when the engine is operating at a high running speed. Hence, the oil system 2 may be configured to provide a flow of oil to the piston cooling jets 30 when the engine assembly is operating at an operating point, e.g. a heat release rate or running speed, greater than a threshold value.

As mentioned above, the engine assembly 1 may comprise a cam shaft 26 configured to control the operation of the inlet and outlet valves 22, 24. The cam shaft may comprise a plurality of cams 26*a*, that each act against a rocker (not shown) as the cam shaft 26 rotates.

Each rocker may push against a valve stem 22*a*, 24*a* of a respective valve 22, 24 in order to open the valve and allow a flow of inlet or exhaust gases through the valve. The valves may each be provided with a spring 22*b*, 24*b* configured to return the valves to closed positions when not being pushed against by the rocker.

The cams 26*a* may be configured such that, at particular points in the rotation of the cam shaft 26, respective ones of the cams are arranged to allow a corresponding valve 22, 24 to be closed. The cams 26*a* may be configured such that when a valve 22, 24 is closed, a clearance gap is provided between the corresponding cam and rocker. This may allow the valve springs 22*b*, 24*b* to act to close the respective valves 22, 24 without the valve stems 22*a*, 24*a* interfering with the rockers or cams 26*a*.

During operation of the engine assembly 1, the temperature of components of the engine assembly may vary, which may vary the size of the clearance gap. A lash adjustor, such as a hydraulic lash adjustor (not shown) may be provided at each of the rockers. The lash adjustor may be configured to adjust the size of the clearance gap, in order to allow the corresponding valve to close. The hydraulic lash adjustors may require a supply of oil in order to operate, and hence, the oil system 2, may be configured to supply oil to the hydraulic lash adjustors. The hydraulic lash adjustors may require oil to be supplied at high pressure, e.g. a higher pressure than the journal bearings 28. However the hydraulic lash adjustors may not require a high flow rate of oil in order to operate.

The engine assembly 1 may comprise further oil consuming components, for example, as depicted in FIG. 1, the engine assembly 1 may comprise a variable valve timing system 32 configured to adjust the timings with which the inlet and/or outlet valves 22, 24 are opened and closed.

The engine assembly 1 may further comprise a turbocharger assembly 34, configured to increase the pressure of inlet air entering the cylinders 16 of the engine assembly 1 via the inlet valves 22. The turbocharger assembly 34 may receive more than one feed of oil from the oil system 2. For example, as depicted in FIG. 1, the turbocharger assembly 34 may receive a first feed of oil 34*a* and a second feed of oil 34*b*. It may be desirable for oil supplied to the first feed 34*a* to be at a higher pressure than oil supplied at the second oil feed 34*b*. In other words, a component of the turbocharger assembly 34 receiving the first feed 34*a* may have a higher oil pressure requirement than a component of the turbocharger assembly receiving the second feed 34*b*. Hence, in the arrangement shown in FIG. 1, the first feed 34*a* is draw from the oil duct from a location close to the oil pump 4. Although it may be desirable to supply the first feed 34*a* with oil at a higher pressure, the second feed 34*b* may require a greater flow rate of oil to be supplied.

As mentioned above, the oil consuming components of the engine assembly 2 may have different requirements of pressure and flow rate of oil in order to operate most effectively. For example, the journal bearings 28 and the piston cooling jets 30 may require a relatively high flow rate of oil, compared to other oil consuming components, however, the journal bearings 28 and PCJs 30 may not require the oil to be provided at high pressure. The hydraulic lash adjustors and the variable valve timing system 32 may require a high pressure of oil to be supplied but may not require large flow rates in order to function effectively. The turbocharger may have different oil pressure and flow rate requirements for each of the feeds to the turbocharger, for example, the second feed 34*b* may require a high flow rate of oil, whilst the first feed 34*a* may require a lower flow rate but may require oil to be supplied at a higher pressure.

In order to allow each of the oil consuming components to operate effectively, the oil pump 4 may be configured to supply a flow rate of oil that is sufficient to supply all of the oil consuming components of the engine assembly. Furthermore, the oil pump 4 may be configured to supply oil at the highest pressure required by the oil consuming components. Hence, when one or more components requiring a high pressure oil supply are operating, such as the hydraulic lash adjustors or variable valve timing system 32, the oil pump 4 may be controlled to provide a high flow rate of oil at the high pressure. The oil pump 4 may require a large amount of power in order to meet the engine requirements of both oil flow rate and oil pressure.

Figure 2:
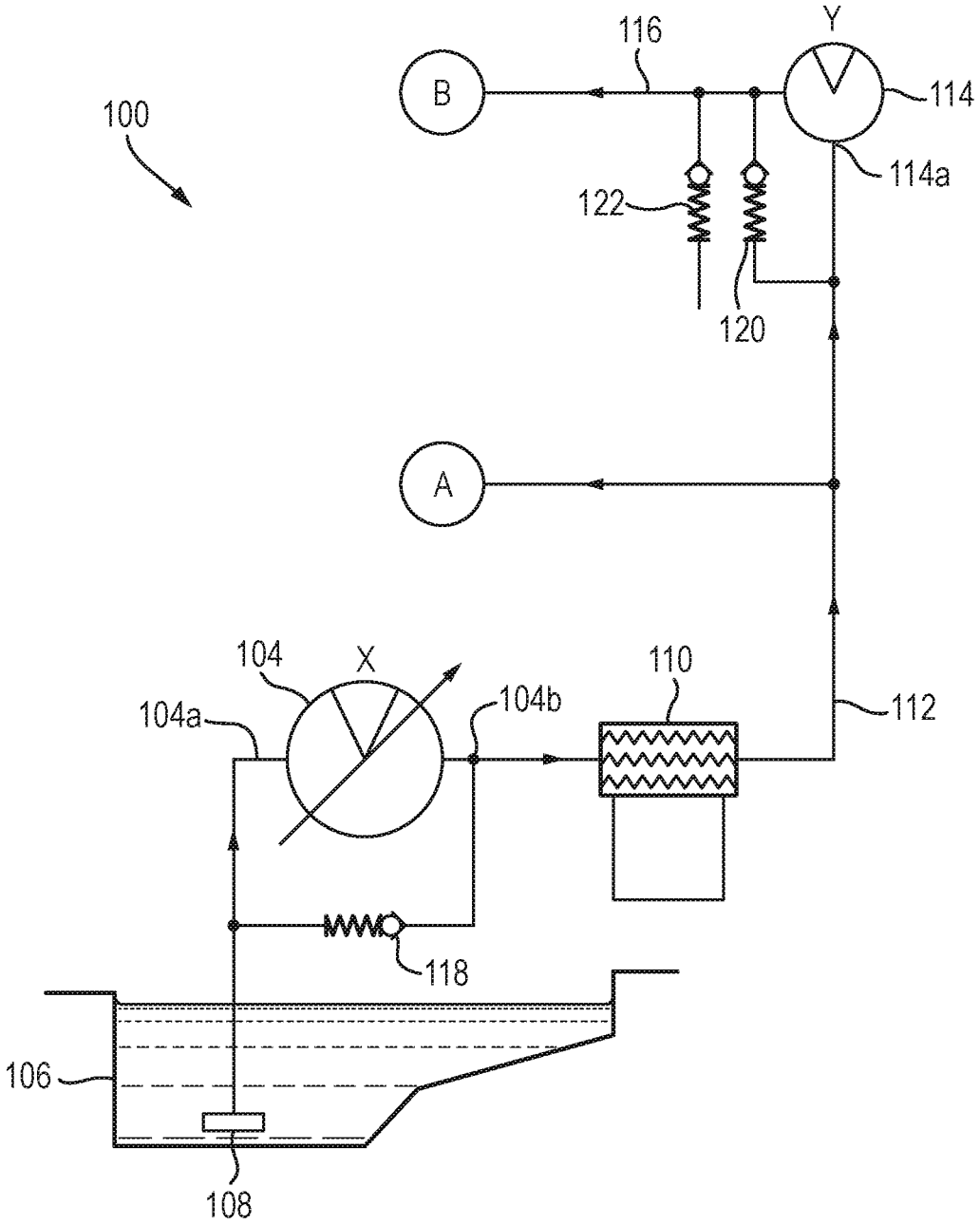
FIG. 2 is a schematic view of an oil system for an engine assembly according to arrangements of the present disclosure.
Figure 3:
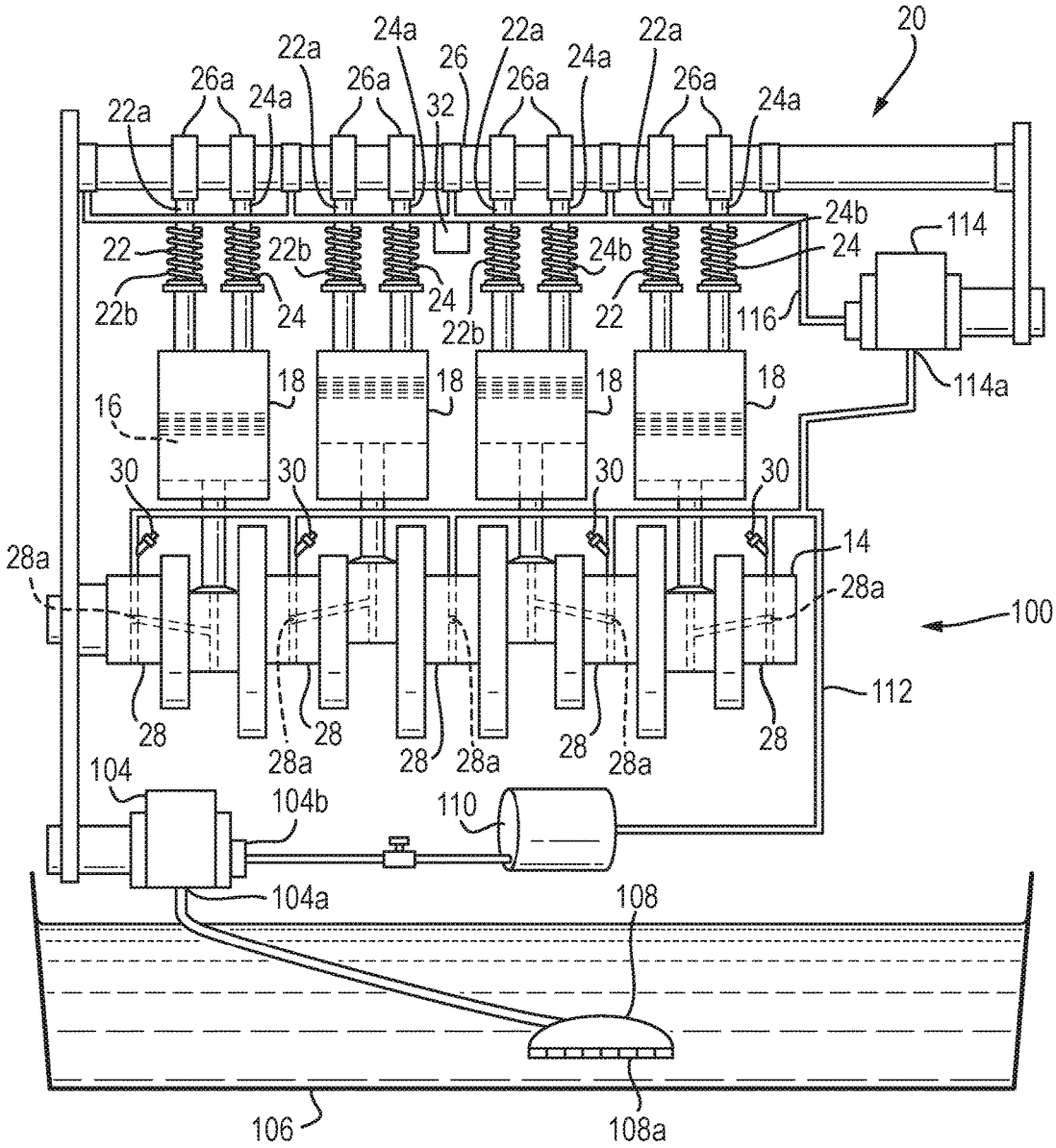
FIG. 3 is a schematic view of an engine assembly according to arrangements of the present disclosure.

With reference to FIGS. 2 and 3, an oil system 100 for an engine assembly of a motor vehicle, according to arrangements of the present disclosure will now be described. As depicted in FIG. 3, the oil system 100 may be provided within the engine assembly 1, e.g. the oil system 100 may be provided in place of the oil system 2. However, it is equally envisaged that the oil system 100 may be provided within any other engine assembly.

The oil system 100 comprises a first oil pump 104. The first oil pump 104 is configured to draw oil from an oil sump 106 of the engine assembly via an oil pick up 108.

Oil may be drawn from the oil sump 106 into an inlet 104*a* of the first oil pump 104. The first oil pump 104 may be configured to increase the pressure of the oil to a first pressure, and may deliver oil at the first pressure from an outlet 104*b* of the first oil pump 104.

As depicted in FIG. 2, the first oil pump 104 may be a variable pump and may be configured to vary the first pressure according to the oil requirement of the engine assembly or one or more components of the engine assembly 1, such as a first group of components A, described below. However, it is equally envisaged that the first oil pump 104 may be a fixed pressure oil pump and the first pressure may be substantially constant.

Oil delivered from the outlet 104*b* of the first oil pump 104 may pass through an oil filter 110 before entering a first oil duct 112. The first oil duct may be configured to deliver oil to the first group of components A of the engine assembly 1.

The components within the first group A may have differing oil flow rate requirements, however each of the components within the first group A may operate effectively when supplied with oil at a low pressure. The first group of components A may include, for example, crank train components, such as the journal bearings 28 and piston cooling jets 30 described above with reference to FIG. 1. The first group of components A may also comprise the component of the turbocharger assembly, which receives the second oil feed 34*b* from the first oil duct 112.

The first oil duct 112 may also deliver oil to a second oil pump 114. The second oil pump 114 may be configured to receive a supply of oil at an inlet 114*a* and pump the oil to a second pressure. The second pressure may be greater than the first pressure and may be greater than a maximum pressure of the first pump 104, e.g. a maximum pressure that the first pump may be controlled to provide.

As shown in FIG. 2, the second oil pump may be a fixed oil pump configured to increase the pressure of oil from the first oil duct 112 by a predetermined pressure difference. However, it is equally envisaged that the second oil pump 114 may be a variable oil pump, which may be controlled according to an oil pressure requirement of the engine assembly or one or more components of the engine assembly, such as a second group of components B, described below. The second oil pump 114 may deliver oil to a second oil duct 116.

The second oil duct 116 may be configured to supply oil to the second group of components B of the engine assembly 1. Each of the components within the second group B may require oil to be supplied at a high pressure, e.g. a higher pressure than the components within the first group A. The second group of components B may include components of the valve train, such as the hydraulic lash adjustors and the variable valve timing system 32 described above with reference to FIG. 1. The second group B may also comprise one or more chain tensioners (not shown) of the engine assembly. The second group B may also comprise the component of the turbocharger assembly, which receives the first oil feed 34*a*.

The second oil pump 114 may have a maximum inlet pressure requirement. In other words, it may not be desirable to supply pressure from the first oil pump 104 to the second oil pump 114 at a pressure greater than a maximum inlet pressure of the second oil pump 114.

In order to control the pressure of oil supplied, the oil system 100 may comprise a first pressure relief valve 118. The first pressure relief valve 118 may comprise a valve, such as a ball valve, configured to allow oil leaving the outlet 104*b* of the first oil pump to be recirculated back to the inlet 104*a* of the first oil pump 104 when a pressure difference between the outlet 104*b* and the inlet 104*a* exceeds a first threshold pressure difference.

One or more of the components within the second group B may have a maximum oil feed pressure. It may not be desirable to supply oil to the components at pressures greater that the maximum oil feed pressure. Hence, the oil system 100 may further comprise a second pressure relief valve 120 configured to regulate the pressure of oil delivered by the second oil pump 114 to the second oil duct 116. The second pressure relief valve 120 may perform in a similar way to the first pressure relief valve 118 and may allow oil leaving the second oil pump 114 to be recirculated back to the inlet 114*a* of the second oil pump 114 when the difference in pressure between an outlet 114*b* of the second oil pump and the inlet 114*a* exceeds a second threshold pressure difference.

The second pressure relief valve 120 may thereby ensure that the pressure increase provided by the second oil pump is less than or equal to the second threshold pressure difference. This may be beneficial for systems such as the turbocharger assembly 34 that include components receiving oil from both the first oil duct 112 and the second oil duct 116.

In some arrangements, it may be desirable to control the absolute pressure of the oil leaving the second oil pump 114, e.g. relative to the pressure of oil within the oil sump 106. The oil system 100 may comprise a third pressure relief valve 122. The third pressure relief valve 122 may be provided between the outlet 114*b* of the second oil pump 114 and the oil sump 106 and may be configured to recirculate oil from the second oil pump 114 back to the oil sump 106 if an absolute pressure of the oil is greater than an absolute threshold pressure.

As depicted in FIG. 2, the third pressure relief valve 122 may be provided downstream of the second pressure relief valve 120. Alternatively, the third pressure relief valve 112 may be provided upstream of the second pressure relief valve 120. In some arrangements, the third pressure relief valve 122 may be provided as an alternative to the second pressure relief valve 120. The absolute pressure threshold may be less than or equal to the sum of the first and second threshold pressure differences.

In the arrangement shown in FIG. 2, the first oil pump 104 supplies oil to the second oil pump 114. Hence, when the first group of components A is receiving oil, the flow rate of oil supplied by the first oil pump 104 is greater than the flow rate of oil supplied by the second oil pump 114. Furthermore, it may be desirable to supply a greater flow rate of oil to the components within the first group A than to the components within the second group B. Hence, the first oil pump 104 may be configured to provide a flow rate that is more than double, e.g. an order of magnitude greater than, the flow rate provided by the second oil pump 114.

In other arrangements of the disclosure (not shown), the second oil pump 114 may not receive oil from the first oil duct 112. For example, the second oil pump 114 may receive oil from the oil sump 106. In such arrangements, the oil system may further comprise a second oil pick-up (not shown) and may comprise a second filter (not shown) configured to reduce the amount of particles in the oil being pumped by the second oil pump 114. Due to the difference in oil flow rate requirements between the component in the first group A and the second group B, even when the second oil pump 114 is configured to receive inlet oil from the oil sump 106, the flow rate of oil provided by the first pump may be greater than twice the flow rate of oil provided by the second oil pump. For example, the flow rate of oil provided by the first pump may be an order of magnitude more than the flow rate of oil provided by the second oil pump.

By providing the first and second oil pumps 104, 114 configured to pump oil to the first and second pressures respectively, the power required by each of the first and second oil pumps 104, 114 may be reduced compared to the oil pump 4 depicted in FIG. 1. The quantity of oil being pumped to a high pressure is reduced and the average pressure to which oil is pumped by the oil system may also be reduced. Hence, a total power required to provide desired flow rates of oil at desired pressures to each of the oil consuming components of the engine assembly 1 may be reduced.

Due to the reduction in power of the first and/or second oil pumps, the size of the first and/or second oil pumps 104, 114 may also be reduced compared to the oil pump 4 depicted in FIG. 1, which may allow the packaging of the oil system 100 to be improved.

As described above with reference to FIG. 1, oil pumps may be driven by the crank shaft 14 of the engine assembly. The components within the first group A may be located close to the crank shaft 14, and hence, it may be desirable for the first pump 104 to be driven by the crank shaft 14. The first pump 104 may be mounted on the crank shaft and driven, e.g. directly driven, by the crank shaft 14. Alternatively, the first pump 104 may be mounted close to, e.g. adjacent to the crank shaft 14 and may be driven via a mechanical drive system, such as the belt drive 5 depicted in FIG. 3 or any other mechanical drive system.

As mentioned above, the second group of components B may comprise components within the valve train 20, such as hydraulic lash adjustor or a variable valve timing system. Accordingly, the components within the second group B may be located close to the cam shaft 26. It may therefore be desirable for the second oil pump 114 to be located close to the cam shaft 26. The second oil pump 114 may be driven by the cam shaft 26. The second oil pump 114 may be mounted on the cam shaft 26 and may be driven, e.g. directly driven, by the cam shaft 26. Alternatively, as depicted in FIG. 3, the second oil pump 114 may be driven via a mechanical drive system, such as a belt drive. Alternatively, the second oil pump 114 may be driven by a chain drive or any other mechanical drive system. Locating the second oil pump 114 adjacent to the valve train 20 reduces the length of piping from the second oil pump to the second group of components B. The pressure losses in the piping may thus be reduced.

As noted above, providing the first and second oil pumps 104, 114 within the oil system 100 allows the power required to drive each of the oil pumps to be reduced. It may therefore be desirable for the first oil pump 104 and/or the second oil pump 114 to be electrically driven. In some arrangements (not shown) the engine assembly 1 may comprise one or more electric motors. The first and or second oil pumps 104, 114 may be driven by a shaft of the electric motors. For example, in one arrangement, the first oil pump 104 may be driven by the crank shaft of the engine assembly, and the second oil pump 114 may be driven by an electrical motor provided within the engine assembly. Providing an electrically driven oil pump may allow for improved packaging of the oil system 200. The second oil pump and electric motor may be located adjacent to the valve train 20, e.g. to reduce pressure losses in oil piping.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It will be appreciated by those skilled in the art that although the disclosure has been described by way of example, with reference to one or more exemplary examples, it is not limited to the disclosed examples and that alternative examples could be constructed without departing from the scope of the disclosure as defined by the appended claims.

The invention claimed is:

1. An internal combustion engine assembly comprising an oil system, the oil system comprising:

a first oil pump configured to supply oil at a first pressure and a first flow rate to a low pressure first feed of a turbocharger and one or more first components of the engine assembly; and a second oil pump configured to supply oil at a second pressure and a lower second flow rate to a higher pressure second feed of the turbocharger and one or more second components of the engine assembly, the second pressure being higher than the first pressure;

wherein the second oil pump is provided adjacent to a valve train of the engine assembly and wherein the first oil pump is provided adjacent to a crank shaft of the engine assembly, and wherein the first oil pump is a variable pressure pump and the second oil pump is a fixed pressure pump.

2. The engine assembly of claim 1, wherein the second oil pump is mounted to the engine assembly at a cam shaft of the engine assembly at a position vertically above the first oil pump.

3. The engine assembly of claim 2, wherein the second oil pump is driven by the cam shaft.

4. The engine assembly of claim 2, wherein the one or more second components of the engine assembly are provided at the cam shaft of the engine assembly.

5. The engine assembly of claim 1, wherein the first oil pump is driven by a different shaft of the engine assembly than the second oil pump.

6. The engine assembly of claim 1, wherein the one or more first components of the engine assembly are provided at the crank shaft of the engine assembly.

7. The engine assembly of claim 1, wherein the first oil pump is driven by the crank shaft of the engine assembly.

8. The engine assembly of claim 1, wherein the second oil pump receives inlet oil from an outlet of the first oil pump.

9. The engine assembly of claim 1, wherein the first oil pump is configured to additionally supply oil to one or more of a journal bearing and a piston cooling jet.

10. The engine assembly of claim 1, wherein the second oil pump is configured to additionally supply oil to one or more of a hydraulic lash adjustor, a variable valve timing system, and a chain tensioner.

11. The engine assembly of claim 1, wherein the first flow rate is greater than the second flow rate, and wherein the second oil pump is driven by an electric motor.

12. The engine assembly of claim 1, wherein the oil system further comprises a first pressure relief valve provided downstream of the first oil pump and configured to control a pressure rise across the first oil pump.

13. The engine assembly of claim 1, wherein the oil system further comprises a second pressure relief valve provided downstream of the second oil pump and configured to control a pressure rise across the second oil pump.

14. The engine assembly of claim 1, wherein the oil system further comprises a third pressure relief valve provided downstream of the second oil pump and configured to control an absolute pressure of oil leaving the second oil pump by selectively permitting oil to return to an oil sump.

15. A motor vehicle comprising an engine assembly, the engine assembly comprising:

an oil system, the oil system comprising:

a first oil pump configured to supply oil at a first pressure and a first flow rate to a low pressure first feed of a turbocharger of the engine assembly; and a second oil pump configured to supply oil at a second pressure and a lower second flow rate to a higher pressure second feed of the turbocharger of the engine assembly, the second pressure being higher than the first pressure;

wherein the second oil pump is provided adjacent to a valve train of the engine assembly and wherein the first oil pump is provided adjacent to a crank shaft of the engine assembly, and wherein the first oil pump is a variable pressure pump and the second oil pump is a fixed pressure pump.

16. The engine assembly of claim 15, wherein the first oil pump is driven by the crank shaft of the engine assembly.

17. The engine assembly of claim 11, wherein the oil system further comprises a first pressure relief valve provided downstream of the first oil pump and configured to control a pressure rise across the first oil pump, and wherein the oil system further comprises a second pressure relief valve provided downstream of the second oil pump and configured to control a pressure rise across the second oil pump.

18. The engine assembly of claim 17, wherein the oil system further comprises a third pressure relief valve provided downstream of the second oil pump and configured to control an absolute pressure of oil leaving the second oil pump by selectively permitting oil to return to an oil sump.

* * * * *